United States Patent [19]

Lamminen

[11] 4,088,531

[45] May 9, 1978

[54] DEWATERING DEVICE FOR THE WIRE SECTION OF A PAPER OR BOARD MACHINE

[75] Inventor: Veikko Lamminen, Tampere, Finland

[73] Assignee: Oy Tampella Ab, Tampere, Finland

[21] Appl. No.: 768,455

[22] Filed: Feb. 14, 1977

[30] Foreign Application Priority Data

Feb. 25, 1976 Finland ..... 760493

[51] Int. Cl.[2] ..... D21F 1/54

[52] U.S. Cl. ..... 162/352; 162/374

[58] Field of Search ..... 162/352, 374

[56] References Cited

U.S. PATENT DOCUMENTS

| | | | |
|---|---|---|---|
| 3,393,124 | 7/1968 | Klingler et al. | 162/352 |
| 3,576,716 | 4/1971 | Reynolds et al. | 162/352 |
| 3,577,316 | 5/1971 | Piette | 162/352 |

*Primary Examiner*—Richard V. Fisher

*Attorney, Agent, or Firm*—Ladas, Parry, Von Gehr, Goldsmith & Deschamps

[57] ABSTRACT

A dewatering device for the wire section of a paper or board machine, comprising a dewatering blade and a supporting rail, the blade extending transversely under said wire in striking contact therewith. The support rail is provided with a guide way forming combined T- and fishtail grooves for supporting in firm engagement selectively a blade provided with a T-guide way or a blade provided with a fishtail guide way.

4 Claims, 5 Drawing Figures

DEWATERING DEVICE FOR THE WIRE SECTION OF A PAPER OR BOARD MACHINE

This invention relates to a dewatering device for the wire section of a paper or board machine, which device comprises a dewatering blade positioned transversely of the direction of movement of a wire, which blade strikes the lower surface of the wire thus subjecting the wire to a suction effect, and a rail supporting the blade, whereby the blade and the rail are slidingly connected to each other by a form joint which comprises two guide ways formed in said blade and said rail respectively and extending transversely of the wire, said guide ways comprising projections formed in the blade and grooves formed in the rail.

It is already known to improve the removal of water from a paper or board web moving on a wire by means of transverse dewatering devices positioned under the wire, which devices subject the sheet to a suction effect improving the removal of water from the web. In order to achieve the desired dewatering effect it is important that the supporting rail fastens the blade into a precisely defined angular position relative to the wire. On the other hand, it is also important that the blade is easily removable from the supporting rail for maintenance, change or the like of the blade without disturbing the operation of the wire. In order to accomplish this it has been earlier suggested to fasten the blade and the rail to each other by means of a T- or a fishtail joint.

In slow paper and board machines in which wear and tear on a dewatering blade is slight, a blade made of plastics is generally used, said blade may be fastened to the supporting rail by means of a T-joint, whereby the guide ways of the supporting rail form T-grooves for the co-acting T-projections of the blade. Such blades made of plastics are used also in fast machines during the start when the most suitable angle positions for the dewatering blades are tested. When using T-joints for blades made of plastics there is achieved in addition to a great accuracy of the angular position an easy removability, and it is easy to accomplish the lateral clearance between the blade and the rail, which is necessary because of the strong thermal expansion of plastics.

In fast machines where the wearing of the blades is stronger, ceramic blades are generally used because of their greater hardness. Ceramic blades, however, are essentially more expensive than blades made of plastics. Because of the lower strength of the ceramic material, ceramic blades can not, like blades made of plastics, be fastened to the supporting rails by T-joints, but they have to be fastened by a fishtail joint which more securely fastens the blade to the rail. Because the thermal expansion in a ceramic blade is smaller, no particular clearance between the blade and the rail is required.

When substituting ceramic blades for plastics blades or vice versa in paper or board machines, it has until now been necessary, due to the different joints, also to change the supporting rails which not only causes extra installation work and increases initial costs but also requires interruption in the operation of the machine.

The object of this invention is to accomplish a dewatering device which eliminates the above disadvantages. This object is achieved by a device according to the invention, which is characterized in that at least one of the grooves of the supporting rail is a combined T- and fishtail groove.

The dewatering device according to the invention makes it possible to substitute a ceramic blade for a blade made of plastics and vice versa without changing the supporting rail because the rail comprises both a T-groove required by the blade made of plastics, and a fishtail groove required by the ceramic blade. Thus the blade can be changed with the least possible costs and without disturbing the operation of the machine.

In the following the invention will be more clearly described with reference to the accompanying drawing, in which FIG. 1 is a cross sectional view of a first embodiment of a dewatering device according to the invention, provided with a blade made of plastics.

Figure 1:
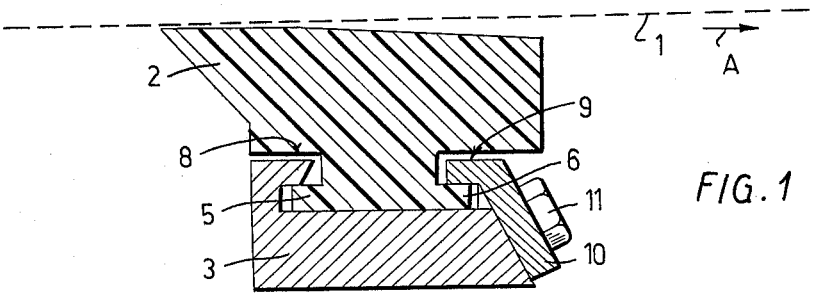
Figure 2:
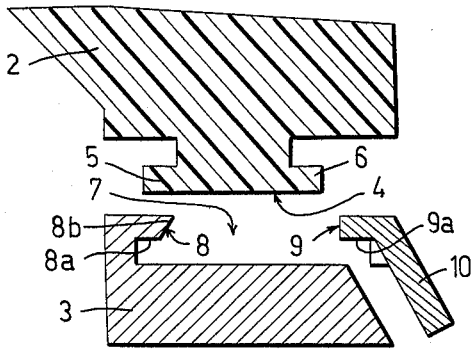
FIG. 2 is a cross sectional view of a dewatering device illustrating the blade and the rail separated from each other.
Figure 3:
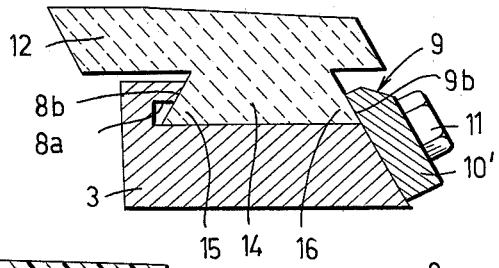
FIG. 3 is a cross sectional view of a dewatering device provided with a ceramic blade.

The dewatering device shown in FIG. 1–3 comprises a blade 2 which is arranged transversely under a wire 1 which transports a web formed in a paper- or board machine, and a rail 3 supporting the blade. The direction of the movement of the wire is indicated with A. The blade strikes along the lower surface of the wire and subjects, due to its special shape, the wire and the web supported by said wire to a suction effect in a known way. In this case the blade is made of plastics and is provided with a T-guide way 4 forming projections 5,6 extending in the longitudinal direction of the blade. The supporting rail is of metal and is provided with a guide way 7 (FIG. 2) forming grooves 8,9 extending in the longitudinal direction of the rail. The left groove 8 of the supporting rail comprises a combined T-groove **8*a* and fishtail groove 8*b*, as shown especially in FIG. 2. Surfaces of the grooves 8*a* and 8*b*** form an obtuse included angle as illustrated.

In the embodiment of the dewatering device shown in FIG. 1–3 the other groove 9 of the supporting rail 5 is formed by two separate guide members 10 and 10', which guide members are alternatively attachable to the body 3 of the supporting rail, by means of bolts 11. Thereby the guide member 10 forms the T-groove **9*a* and the other guide member 10' forms the fishtail groove 9*b***.

It is apparent that by using the grooves 8,9 formed in accordance with the present invention it is possible to attach both the plastics blade 2 provided with the T-guide way 4 having the projections 5,6, and a ceramic blade 12 provided with a fishtail guide way 14 having projections 15,16 (FIG. 3), accurately and steadily to the same supporting rail 3. The guide member 10 provided with the T-groove **9*a* is used for fastening the plastics blade 2, and the guide member 10' provided with the fishtail groove 9*b* is used for fastening the ceramic blade 12**.

Figure 4:
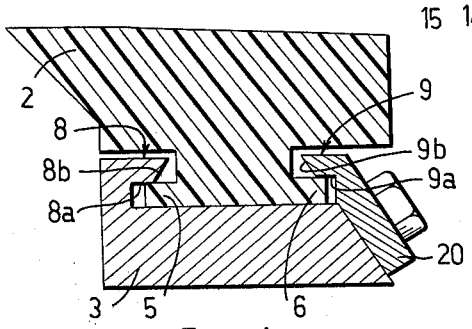
FIG. 4 is a cross sectional view of a second embodiment of a dewatering device.

The only difference between the second embodiment of the dewatering device, shown in FIG. 4, and the first one is, that in this second embodiment the T-groove **9*a* and the fishtail groove 9*b* are formed in the same guide member 20**.

Figure 5:
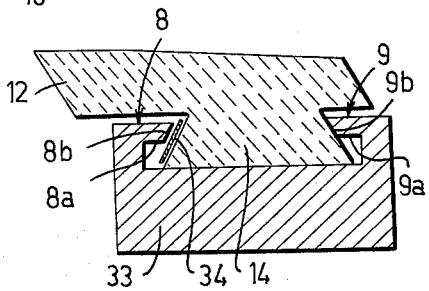
FIG. 5 is a cross sectional view of a third embodiment of a dewatering device.

In the third embodiment of the dewatering device shown in FIG. 5 the groove 9 is formed integrally with the supporting rail 33. In the same way as in the earlier embodiments the groove comprises a T-groove 9*a* and a fishtail groove 9*b*. The reference number 34 indicates a flexible metal member known per se arranged between the blade 12 and the groove 8 of the supporting rail for facilitating a steady attachment of the blade.

It is apparent that in all cases the same supporting rail can be used when substituting a ceramic blade for a plastics blade and vice versa. The blade is easy to remove from the supporting rail and to push back into the rail in the transverse direction of the wire.

The drawing and the description only visualize the basic idea of the invention. In detail the dewatering device according to the invention can vary considerably within the claims.

What I claim is:

1. A dewatering device for the wire section of a paper or board machine, said device comprising a dewatering blade located below said wire and transversely of the direction of movement thereof and a rail supporting the blade, said blade and rail being slidably connected to each other by a joint incorporating two guide ways formed respectively in said blade and said rail and extending transversely of the wire, the guide way of the blade comprising two projections and the guide way of the rail comprising two grooves, at least one of said grooves being a combined T-and fishtail groove having a T-groove surface and a fishtail groove surface, said surfaces forming an obtuse included angle.

2. A dewatering device according to claim 1, wherein both grooves of the supporting rail are combined T-and fishtail grooves.

3. A dewatering device according to claim 1, wherein one of said grooves is formed as a combined T-and fishtail groove and the other of said grooves is defined by a separate guide member attachable to the body of the rail, said guide member together with the body of the rail forming a combined T-and fishtail groove.

4. A dewatering device according to claim 1, wherein one of said grooves if formed as a combined T-and fishtail groove and the other of said grooves is defined by alternative guide members attachable to the body of the rail, a first of said guide members being shaped to form a T-groove and the other of said guide members being shaped to form a fishtail groove.

* * * * *